US007547811B2

(12) United States Patent
Kramer et al.

(10) Patent No.: US 7,547,811 B2
(45) Date of Patent: Jun. 16, 2009

(54) HIGH VISCOSITY POLYALPHAOLEFINS BASED ON 1-HEXENE, 1-DODECENE AND 1-TETRADECENE

(75) Inventors: Anatoly Ilich Kramer, Edison, NJ (US); Phil Surana, Somerset, NJ (US); Pramod Jayant Nandapurkar, Plainsboro, NJ (US); Norman Yang, Westfield, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 175 days.

(21) Appl. No.: 11/388,285

(22) Filed: Mar. 24, 2006

(65) Prior Publication Data

US 2007/0225533 A1 Sep. 27, 2007

(51) Int. Cl.
*C07C 2/02* (2006.01)
*C10L 1/16* (2006.01)

(52) U.S. Cl. ..... 585/532; 585/510; 585/520

(58) Field of Classification Search ..... 585/520, 585/532, 533
See application file for complete search history.

(56) References Cited

U.S. PATENT DOCUMENTS

| | | | | |
|---|---|---|---|---|
| 3,149,178 | A | 9/1964 | Hamilton et al. | 260/683.9 |
| 3,382,291 | A | 5/1968 | Brennan | 260/683.15 |
| 3,742,082 | A | 6/1973 | Brennan | 260/683.9 |
| 3,780,128 | A | 12/1973 | Shubkin | 260/683.9 |
| 4,045,507 | A | 8/1977 | Cupples et al. | 260/683.15 |
| 4,172,855 | A | 10/1979 | Shubkin et al. | 585/16 |
| 4,533,782 | A | 8/1985 | Merijanian | 585/520 |
| 4,956,122 | A | 9/1990 | Watts et al. | 252/565 |
| 5,146,022 | A | 9/1992 | Buchanan et al. | |
| 5,157,177 | A | 10/1992 | Pelrine et al. | |
| 5,196,635 | A * | 3/1993 | Kumar et al. | 585/532 |
| 5,284,988 | A * | 2/1994 | Schaerl et al. | 585/525 |
| 5,693,598 | A | 12/1997 | Abraham et al. | 508/444 |
| 6,071,863 | A | 6/2000 | Benda et al. | 508/591 |
| 6,303,548 | B2 | 10/2001 | Gao | 508/469 |
| 6,313,077 | B1 | 11/2001 | Stunnenberg et al. | 508/591 |
| 6,395,948 | B1 | 5/2002 | Hope et al. | 585/510 |
| 6,646,174 | B2 | 11/2003 | Clarembeau | 585/525 |
| 6,686,511 | B2 | 2/2004 | Miller et al. | 585/519 |
| 6,706,828 | B2 | 3/2004 | DiMaio | 526/160 |
| 6,713,582 | B2 | 3/2004 | DiMaio et al. | 526/281 |
| 6,824,671 | B2 | 11/2004 | Goze et al. | 208/19 |
| 6,869,917 | B2 | 3/2005 | Deckman et al. | 508/110 |
| 6,949,688 | B2 | 9/2005 | Goze et al. | 585/525 |
| 2002/0128532 | A1 | 9/2002 | Hope et al. | 585/521 |
| 2002/0137636 | A1 | 9/2002 | Hartley et al. | 508/110 |
| 2003/0055184 | A1 | 3/2003 | Song et al. | |
| 2003/0119682 | A1 | 6/2003 | Saini et al. | 508/167 |
| 2003/0166986 | A1 | 9/2003 | Clarembeau | 585/525 |
| 2004/0030075 | A1 | 2/2004 | Hope et al. | 526/237 |
| 2004/0033908 | A1 | 2/2004 | Deckman et al. | 508/110 |
| 2004/0129603 | A1 | 7/2004 | Fyfe et al. | 208/18 |
| 2004/0154957 | A1 | 8/2004 | Keeney et al. | 208/18 |
| 2004/0154958 | A1 | 8/2004 | Alexander et al. | 208/18 |
| 2006/0211904 | A1 | 9/2006 | Goze et al. | 585/520 |

FOREIGN PATENT DOCUMENTS

| | | |
|---|---|---|
| JP | 01095108 | 4/1989 |
| RU | 2212936 | 9/2003 |
| WO | WO 99/38938 | 8/1999 |

OTHER PUBLICATIONS

"Next Generation Polyalphaolefins—The Next Step in the Evolution of Synthetic Hydrocarbon Fluids", Moore et al., Innovene USA LLC Nov. 22, 2005 revision; posted Nov. 22, 2005 at www.innovene.com.

* cited by examiner

*Primary Examiner*—In Suk Bullock
*Assistant Examiner*—Glenn A Caldarola
(74) *Attorney, Agent, or Firm*—Nancy T. Krawczyk; Andrew B. Griffis

(57) ABSTRACT

This invention relates to the use of olefin mixtures containing 1-hexene/1-decene/1-dodecene and, additionally, 1-octene or 1-decene to produce high viscosity polyalphaolefins (PAOs) having a viscosity of from about 40 cSt to about 100 cSt at 100° C. (ASTM D-445) and a number average molecular weight of between about 1200 to about 4000, particularly useful as lubricant base stocks.

12 Claims, No Drawings

HIGH VISCOSITY POLYALPHAOLEFINS BASED ON 1-HEXENE, 1-DODECENE AND 1-TETRADECENE

FIELD OF THE INVENTION

The invention is directed to a process for making high viscosity polyalphaolfins (PAOs). The products are especially useful as lubricant base stocks.

BACKGROUND OF THE INVENTION

PAOs comprise a class of hydrocarbon lubricants which has achieved importance in the lubricating oil market. These materials are typically produced by the catalytic oligomerization (polymerization to low-molecular-weight products) of α-olefins typically ranging from 1-octene to 1-dodecene, with 1-decene being a preferred material, although polymers of lower olefins such as ethylene and propylene may also be used, including copolymers of ethylene with higher olefins, as described in U.S. Pat. No. 4,956,122 and the patents referred to therein. PAO products may be obtained with a wide range of viscosities varying from highly mobile fluids of about 2 cSt at 100° C. to higher molecular weight, viscous materials which have viscosities exceeding 100 cSt at 100° C.

The PAO's are typically produced by the polymerization of olefin feed in the presence of a catalyst such as $AlCl_3$ or $BF_3$. Processes for the production of PAO lubricants are disclosed in numerous patents, for example, U.S. Pat. Nos. 3,149,178; 3,382,291; 3,742,082; 3,780,128; 4,172,855 and 4,956,122.

High viscosity PAOs (defined herein as PAOs having a kinematic viscosity at 100° C. of >20 cSt as measured by ASTM D 445) are normally produced via cationic oligomerization of linear alpha olefins. 1-decene is the preferred olefin for oligomerization. PAOs have also been produced using mixtures of olefins containing 1-octene and 1-dodecene as well as 1-decene and 1-dodecene.

High viscosity PAOs produced via $AlCl_3$ catalyzed olefin oligomerization have been available commercially for many years, e.g., from ExxonMobil Chemical Company. These PAOs are produced either from 1-decene, or from mixtures containing 1-octene, 1-decene and/or 1-dodecene. When oligomerizing olefin mixtures, the composition needs to be carefully controlled to produce PAOs with the desired blend of low temperature properties including pour point, viscosity, and appearance. Typically, use of olefins with molecular weight greater than 1-decene results in PAOs with high pour points. As a result, when oligomerizing olefin mixtures, a combination of low and high molecular weight olefins (with respect to 1-decene) is generally used.

U.S. Pat. No. 4,533,782 is directed to polymerizing cationically polymerizable monomers including C3-C14 linear or branched 1-olefins using a catalyst comprising an aluminum compound of the formula $R_nAlX_{3-n}$ and a compound having the formula R'X (X being a halide in both formulas) in solution.

U.S. Pat. No. 5,196,635 discloses the use of a catalyst prepared by reacting in an organic solvent an aluminum halide and a proton donor useful in oligomerizing C6 to C20 straight chain alpha olefins.

U.S. Pat. No. 6,646,174 teaches a process for oliogmerization of 1-dodecene and 1-decene to produce a PAO product having a kinematic viscosity in the range of from about 4 to about 6 cSt at 100° C. and a viscosity index of 130 to 145, and a pour point of −60° C. to −50° C.

U.S. Pat. No. 6,686,511 directed to a process for making a lube base stock having at least four steps, including separation of an olefinic feedstock in a first separator into fractions and contacting a light olefin fraction with a first oligomerization catalyst in a first oligomerization zone to produce a first product, which is subsequently contacted with a medium olefin fraction and an oligomerization catalyst in a second oligomerization zone to produce a second product.

U.S. Pat. No. 6,395,948 discloses the use of an acidic ionic liquid oligomerization catalyst, described by the general formula $Q^+A^-$, for the preparation of high viscosity PAOs from decene or dodecene in the absence of an organic diluent. See also U.S. Application Nos. 2002/0128532 and 2004/0030075.

JP1095108 is directed to a method for manufacturing an olefin oligomer using a Lewis acid and an alkyl cyclohexane.

RU2212936 is directed to a cationic oligomerization of olefins that uses a catalyst containing active aluminum and a co-catalyst that is an organohalide compound RX, where R is a primary, secondary, or tertiary alkyl, allyl, benzyl, acetyl or benzoyl and X is chlorine, bromine or iodine.

Additional patents of interest include WO 99/38938 and U.S. Pat. Nos. 6,706,828 and 6,713,582.

Current practice does not provide enough flexibility in the choice of feed olefin/olefin mixtures that can lead to an economic method of achieving a high viscosity PAO composition having adequate low temperature performance suitable for end use applications such as industrial lubricants.

The present inventors have surprisingly discovered a method of producing high viscosity PAOs having excellent low temperature performance from a mixture containing hexene/dodecene/tetradecene ($C_6/C_{12}/C_{14}$) linear alpha olefins.

SUMMARY OF INVENTION

The present inventors have discovered a process which comprises co-feeding a linear alpha olefin (LAO) mixture comprising hexene/dodecene/tetradecene ($C_6/C_{12}/C_{14}$), optionally further including C8 or C10 (e.g., mixtures comprising hexene/octene/dodecene/tetradecene ($C_6/C_8/C_{12}/C_{14}$) or hexene/decene/dodecene/tetradecene ($C_6/C_{10}/C_{12}/C_{14}$)) into a reaction vessel and oligomerizing said mixture in the presence of an aluminum chloride-water complex which may be co-fed concurrently with the feed, to produce polyalphaolefins having a nominal viscosity of between about 20 cSt and 100 cSt (100° C.). The products are particularly useful as lubricant base stocks.

The hexene/dodecene/tetradecene or 1-hexene/11-decene/11-dodecene/1-tetradecene or hexene/octene/dodecene/tetradecene mixtures can be oligomerized to high viscosity PAOs which may be characterized by a nominal viscosity (kinematic viscosity) of from about 20 to about 100 cSt at 100° C. (ASTM D-445), and in an embodiment possess desired low temperature properties, such as low pour point.

In an embodiment, the process introduces the mixture of olefins with a catalyst into a first reactor to produce a partially reacted product that is fed into a second reactor to complete the reaction. In yet another embodiment, the process uses 3-reactors in series to complete the reaction.

In another embodiment, the process produces a 40 cSt PAO at 100° C. in the absence of a solvent and in still another embodiment, the process produces a 100 cSt PAO at 100° C. using a solvent. In yet another embodiment, the high viscosity PAOs of the present invention have a number average molecular weight of between about 1200 to about 4000.

These and other embodiments, objects, features, and advantages will become apparent as reference is made to the following drawings, detailed description, examples, and appended claims.

DETAILED DESCRIPTION

The invention is directed to PAOs prepared from mixtures of linear alpha olefins comprising 1-hexene/1-dodecene/1-tetradecene, optionally with 1-octene or 1-decene (i.e., also including PAOs prepared from mixtures of 1-hexene/1-decene/1-dodecene/1-tetradecene or 1-hexene/1-octene/1-dodecene/1-tetradecene). The mixture of LAOs according to the invention are oligomerized using an aluminum halide complex with water to produce high viscosity PAOs having, in an embodiment, a kinematic viscosity of from about 40 and about 100 cSt at 100° C. (ASTM D-445) and which in an embodiment possess the desired low temperature properties, such as low pour point.

The phrase "linear alpha olefins (or "LAOs") comprising hexene, 1-dodecene, and 1-tetradecene" will be used interchangeable herein with "1-hexene/1-dodecene/1-tetradecene" and also the expression "$C_6/C_{12}/C_{14}$". These are all synonymous. The same is applicable to LAO mixtures of 1-hexene/1-decene/1-dodecene/1-tetradecene or 1-hexene/1-octene/1-dodecene/1-tetradecene.

In embodiments, the process according to the invention comprises co-feeding the mixture of linear alpha olefins according to the invention concurrently with the catalyst. The catalyst may be any known catalyst for the polymerization of LAOs to PAOs, such as $AlCl_3$. Preferably, the catalyst is a complex comprising a proton donor such as water with an aluminum halide, preferably aluminum trichloride-water complex having 0.5 moles of water per mole of aluminum chloride. The reaction may be batch, semi-batch or continuous, in a single or multi-stage reactors. In a preferred embodiment, the mixture of catalyst and linear alpha olefins (LAOs) is preferably fed into a first oligomerization reactor where it is partially reacted and then into a second oligomerization reactor where the reaction may be allowed to continue to completion or where the reaction may be allowed to proceed further and then the mixture of catalyst, linear alpha olefins and oligomers are fed into a third oligomerization reactor where the reaction is completed. Additional oligomerization reactors may be used in series. The vapor phase in the reactor includes hydrogen chloride, amongst other species. Alternately, hydrogen chloride can be injected into the reactor.

The reaction zone may be any reaction means known in the art that provides for the reaction under suitable conditions maintained and controlled so as to provide for the production of oligomers of the LAO feed. The LAO feed comprising a mixture of $C_6/C_{12}/C_{14}$ and catalyst may be introduced either separately or together into the first reaction zone. It is preferred that the reactors each be equipped with a mixing or stirring means for mixing the feed and catalyst to provide intimate contact. In a more preferred embodiment, continuous stirred tank reactors (CSTRs) are used in series. The operation of CSTRs are per se known in the art. Also in an embodiment, no recycle of unconverted monomer is used. In a yet another embodiment, recycle of unconverted monomer is allowed.

An effective amount of catalyst is provided. One of ordinary skill in the art in possession of the present disclosure can determine an effective amount without undue experimentation. In a preferred embodiment, the catalyst concentration is between 0.5 to 4 wt % of the total reaction mass (e.g., monomers, catalyst, diluent and/or other optional ingredients). It is known in the art that the addition of aromatics in small amounts improves the oligomerization of LAOs. In the 100 cSt examples below, 0.5 wt. % xylenes was present in the feed. Unless otherwise specified, the amounts given for the feed are in wt %. Thus for a feed of $C_6/C_{12}/C_{14}$, "25/25/50" means 25 wt % of $C_6$ olefin, 25 wt % of $C_{12}$ olefin, and 50 Wt % of $C_{14}$ olefin.

Reaction conditions are such as to cause effective conversion of monomers to the desired product. Such conditions may also be determined by one of ordinary skill in the art in possession of the present disclosure without undue experimentation. In a preferred embodiment, the reactor temperatures are between about 80 and 140° F. (between about 26 and 60° C.) and residence time of about 1.5 to about 3 hours in reactor one and about 0.5 to about 1.5 hours in reactor 2, if used. The residence time in a third reactor, if used would typically be from about 10 minutes to about 1 hour. The reaction is not particularly pressure-dependent and it is most economical to operate the reactors at a low pressure, preferably from about atmospheric to about 50 psia.

In an embodiment, no solvent is used. In another embodiment, an inert diluent may be used, preferably selected from fluids such as C5-C19 paraffinic hydrocarbons, preferably a C6-C13 paraffinic fluid such as Norpar™ 12 fluid, an aliphatic (paraffinic) solvent having primarily twelve carbon aliphatic compounds, available from ExxonMobil Chemical Company, Baytown, Tex.

The product of the reaction typically comprises C20-24 dimers, C30-36 trimers, C40-48 tetramers, C50-60 pentamers, and C60+ heavies.

The reaction mixture is then distilled to remove unreacted monomeric and dimeric species. In a preferred embodiment, the resulting product is typically hydrogenated to saturate the oligomers to provide a product having a desired viscosity, for example 40 cSt or 100 cSt at 100° C.

The following examples are meant to illustrate the present invention and provide a comparison with other methods and the products produced therefrom. Numerous modifications and variations are possible and it is to be understood that within the scope of the appended claims, the invention may be practiced otherwise than as specifically described herein.

The reactions were carried out in a three-neck 5-liter round bottom jacketed glass flask (reactor) that was fitted with a motor driven stirrer and a baffle. A pump circulated chilled water through the jacket to control reaction temperature. About two thousand grams of the LAO feed were charged into a feed burette. In the case of 100 cSt PAO, Norpar® 12 Fluid was also added to the olefin mixture (25-30 wt. % of olefins) to improve mixing and heat transfer during oligomerization. No diluent was added in the case of the 40 cSt PAO. A pump was used to feed the LAO into the reactor at a controlled rate. The reactor was dried and purged with dry nitrogen to remove moisture before the start of oligomerization. The reactor was continuously purged with small amount of nitrogen during the reaction as well. The desired amount of $AlCl_3$ catalyst, 0.8 to 4.0 wt. % of feed, was pre-weighed and stored in closed glass vials. The $AlCl_3$ is commercially available from numerous sources. The $AlCl_3$ used below was purchased from Gulbrandsen Chemicals. Other cationic oligomerization catalysts such as $AlBr_3$ will also be efficient according to the present investigation. In the case of $AlCl_3$, the present inventors have found that less catalyst is necessary when using finer granularity catalyst.

At the start of oligomerization, feed olefin mixture was pumped into the flask for 15 minutes under vigorous agitation, and with cooling water flowing through the jacket. The $AlCl_3$ catalyst from a glass vial was emptied into the reactor next, and a measured amount of DI (deionized) water was injected into the flask via a long needle syringe. The amount of DI water injected corresponded to 0.5 moles of water/mole of $AlCl_3$. The feed was added continuously over a period of two to five hours into the reactor. The required amounts of catalyst and DI water were added at the intervals of 15 minutes. The oligomerization reaction was allowed to proceed additional one to three hours after the olefin and catalyst additions were completed. The reaction temperature ranged between 30° C. to 60° C.

The reaction was quenched by adding the reactor contents into an equal volume of caustic (5 wt. % aqueous sodium hydroxide) solution at 45-80° C. The quenched mass was subsequently washed two times with hot water at 45-80° C. The viscous oil was next separated from the aqueous layer and distilled to remove water, unconverted monomer and dimer (and solvent if present). A material balance on the distillation indicated a feed olefin conversion of 98-99%. The viscous oil was de-chlorinated thermally and hydrogenated over Pd catalyst.

For each of the reported examples below, 100° C. and 40° C. Kinematic Viscosity was measured according to ASTM D-445 at the respective temperatures; Pour Point was determined according to ASTM D-97; and Viscosity Index (VI) was determined according to ASTM D-2270. Number average molecular weight (Mn) was measured by Gel Permeation Chromatography using a Waters 150 gel permeation chromatograph equipped with a differential refractive index (DRI) detector. The numerical analyses were performed using the commercially available standard Gel Permeation chromatography software package.

Experiments were carried out with different molecular weight olefins, with a differing olefin ratio in the feed, and by varying oligomerization conditions. Oligomerization was conducted both in a semi-batch mode (continuous addition of feed olefin and catalyst into the reactor followed by a period of "hold") and in a continuous stirred tank reactor mode.

40 cSt PAO based on $C_6/C_{12}/C_{14}$ The physical property data for commercial PAOs produced with conventional olefin feed (either 1-decene or 1-octene/1-dodecene) is shown as examples 1 and 2 in the table below. A pour point of −42° C. is obtained for the product. Oligomerization of a 55/45 wt % mixture of $C_{10}/C_{12}$ olefins resulted in a PAO with identical pour point (example 3). A similar pour point was also obtained when the content of 1-dodecene in the feed was increased to 50% as shown in example 4. Oligomerization experiments with $C_{12}$ olefin alone, however, caused the PAO pour point to increase to −33° C. as demonstrated by example 5. The viscosity index, VI, of this product was also higher. The pour point increased even further to −21° C. when a 50/50 (wt %) mixture of $C_{12}/C_{14}$ olefins was used (example 6).

When oligomerization was conducted using 1-hexene/1-tetradecene the, the resulted product had unacceptably high pour point, above −36 C (examples 8-9), or VI lower than 147 (examples 7-8). Experiment with 50/50 1-hexene/1-dodecene produced product with very low VI of 133 (example 10). Surprisingly, when we conducted oligomerization with 1-hexene/1-dodecene/1-tetradecene (examples 11-19), several resulted 40 cSt PAO products had acceptable physical properties including VI and pour points (examples 13-18). It is thus quite apparent that we can produce 40 cSt PAO product with desired properties using $C_{16}/C_{12}/C_{14}$ olefin blend as a feed.

TABLE 1

| Example | Feed Olefin | 100° C. Viscosity | 40° C. Viscosity | VI | Pour Point, ° C. |
|---|---|---|---|---|---|
| 1 | $C_{10}$ | 39 | 383 | 149 | −42 |
| 2 | 50/50 $C_8/C_{12}$ | 39.5 | 393 | 147 | −42 |
| 3 | 55/45 $C_{10}/C_{12}$ | 39.7 | 386 | 152 | −42 |
| 4 | 50/50 $C_{10}/C_{12}$ | 38.8 | 378 | 151 | −42 |

TABLE 1-continued

| Example | Feed Olefin | 100° C. Viscosity | 40° C. Viscosity | VI | Pour Point, ° C. |
|---|---|---|---|---|---|
| 5 | $C_{12}$ | 38.2 | 351 | 158 | −33 |
| 6 | 50/50 $C_{12}/C_{14}$ | 40.5 | 371 | 161 | −21 |
| 7 | 50/50 $C_6/C_{14}$ | 40.3 | 452 | 137 | −36 |
| 8 | 40/60 $C_6/C_{14}$ | 37.1 | 386.6 | 142 | −33 |
| 9 | 30/70 $C_6/C_{14}$ | 43.3 | 452.9 | 148 | −27 |
| 10 | 50/50 $C_6/C_{12}$ | 37.3 | 420.5 | 133 | −39 |
| 11 | 30/30/40 $C_6/C_{12}/C_{14}$ | 43.8 | 467 | 147 | −33 |
| 12 | 30/40/30 $C_6/C_{12}/C_{14}$ | 39.8 | 413.1 | 145 | −36 |
| 13 | 30/50/20 $C_6/C_{12}/C_{14}$ | 41.0 | 433.9 | 144 | −39 |
| 14 | 25/45/30 $C_6/C_{12}/C_{14}$ | 41.1 | 421.2 | 148 | −36 |
| 15 | 25/50/25 $C_6/C_{12}/C_{14}$ | 40.7 | 417.0 | 148 | −36 |
| 16 | 25/60/15 $C_6/C_{12}/C_{14}$ | 40.7 | 420.1 | 147 | −39 |
| 17 | 20/60/20 $C_6/C_{12}/C_{14}$ | 40.5 | 404.8 | 150 | −36 |
| 18 | 15/70/15 $C_6/C_{12}/C_{14}$ | 40.9 | 403.3 | 153 | −36 |
| 19 | 15/60/25 $C_6/C_{12}/C_{14}$ | 39.6 | 386.8 | 152 | −33 |

100 cSt PAO based on $C_6/C_{12}/C_{14}$ The physical property data on commercial 100 cSt PAOs, obtained with conventional olefin feed (either 1-decene, 1-octene/1-dodecene or 1-decene/1-dodecene), is shown in the table below (examples 1, 2 and 3). A pour point of −33° C. is obtained for the product. Oligomerization of 1-tetradecene resulted in product with a pour point of −9 C as shown in example 4. The pour point improved to −27 C when using 1-dodecene but is still inferior to the commercial product (example 5). The use of 1-hexene/1-tetradecene olefin feed resulted in PAO with a pour point of −24 C and −27 C respectively, as demonstrated in examples 6 and 7. Although pour point improved by increasing the content of 1-hexene, the Viscosity Index of the product decreased correspondingly (an undesirable result). Experiments were therefore carried out with a feed containing 1-hexene, 1-dodecene and 1-tetradecene. Examples 8 through 12 indicate that a PAO can be produced with pour point approaching that of commercial product (−30 C) using a range of composition involving 1-hexene/1-dodecene/1-tetradecene. The Viscosity Index of this product is also comparable to the commercial product.

It is thus discovered that a 100 cSt PAO with desirable pour point and viscosity index can be produced by using olefin mixtures containing 1-hexene/1-dodecene/1-tetradecene.

TABLE 2

| Example | Feed Olefin | 100° C. Viscosity | 40° C. Viscosity | VI | Pour Point, ° C. |
|---|---|---|---|---|---|
| 1 | $C_{10}$ | 102 | 1289 | 168 | −33 |
| 2 | 50/50 $C_8/C_{12}$ | 100.5 | 1267 | 168 | −33 |
| 3 | 55/45 $C_{10}/C_{12}$ | 107.2 | 1332 | 173 | −33 |
| 4 | $C_{14}$ | — | — | — | −9 |
| 5 | $C_{12}$ | 104 | 1234 | 176 | −27 |
| 6 | 30/70 $C_6/C_{14}$ | 106.3 | 1349 | 170 | −24 |
| 7 | 50/50 $C_6/C_{14}$ | 98.3 | 1367 | 157 | −27 |
| 8 | 25/40/35 $C_6/C_{12}/C_{14}$ | 104.4 | 1328 | 169 | −30 |
| 9 | 25/50/25 $C_6/C_{12}/C_{14}$ | 107.6 | 1366 | 170 | −30 |

TABLE 2-continued

| Example | Feed Olefin | 100° C. Viscosity | 40° C. Viscosity | VI | Pour Point, ° C. |
|---|---|---|---|---|---|
| 10 | 25/60/15 $C_6/C_{12}/C_{14}$ | 106.9 | 1376 | 169 | −30 |
| 11 | 20/60/20 $C_6/C_{12}/C_{14}$ | 108.7 | 1373 | 171 | −30 |
| 12 | 15/60/25 $C_6/C_{12}/C_{14}$ | 104.4 | 1279 | 173 | −30 |

40 cSt PAO based on $C_6/C_8/C_{12}/C_{14}$ olefin mixtures are now described.

The physical property data for 40 cSt PAO is shown in the Table below.

TABLE 3

| Example | Feed Olefin $C_6/C_8/C_{12}/C_{14}$ | 100° C. Viscosity | 40° C. Viscosity | VI | Pour Point, ° C. |
|---|---|---|---|---|---|
| 1 | 20/10/50/20 | 43.2 | 450.2 | 149 | −39 |
| 2 | 25/10/50/15 | 41.9 | 441.9 | 146 | −39 |
| 3 | 25/10/45/20 | 42.6 | 454.9 | 145 | −39 |
| 4 | 20/10/55/15 | 40.0 | 411.8 | 146 | −42 |

All feed compositions examined produced 40 cSt PAOs with excellent properties. The pour point and VI of these PAOs approach that of the commercially produced PAO.

100 cSt PAO based on $C_6/C_8/C_{12}/C_{14}$ olefin mixtures are now described.

The physical property data for 100 cSt PAO is shown in the Table below.

TABLE 4

| Example | Feed Olefin $C_6/C_8/C_{12}/C_{14}$ | 100° C. Viscosity | 40° C. Viscosity | VI | Pour Point, ° C. |
|---|---|---|---|---|---|
| 1 | 20/10/50/20 | 117 | 1510 | 173 | −30 |
| 2 | 25/10/50/15 | 114.6 | 1512 | 170 | −30 |
| 3 | 25/10/40/25 | 109 | 1434 | 168 | −30 |
| 4 | 20/10/55/15 | 110 | 1439 | 169 | −30 |

All feed compositions examined produced 100 cSt PAOs with excellent properties. The pour point and VI of these PAOs approach that of the commercially produced PAO.

40 cSt PAO based on $C_6/C_{10}/C_{12}/C_{14}$ olefin mixtures are now described.

The physical property data for 40 cSt PAO is shown in the Table below.

TABLE 5

| Example | Feed Olefin $C_6/C_{10}/C_{12}/C_{14}$ | 100° C. Viscosity | 40° C. Viscosity | VI | Pour Point, ° C. |
|---|---|---|---|---|---|
| 1 | 20/10/50/20 | 41.1 | 423 | 148 | −39 |
| 2 | 25/10/50/15 | 41.6 | 434 | 147 | −39 |
| 3 | 25/10/45/20 | 41.3 | 431 | 146 | −39 |
| 4 | 20/10/55/15 | 42.8 | 443 | 149 | −39 |

All feed compositions examined produced 40 cSt PAOs with excellent properties. The pour point and VI of these PAOs approach that of the commercially produced PAO.

100 cSt PAO based on $C_6/C_{10}/C_{12}/C_{14}$ olefin mixtures are now described.

The physical property data for 100 cSt PAO is shown in the Table below.

TABLE 6

| Example | Feed Olefin $C_6/C_{10}/C_{12}/C_{14}$ | 100° C. Viscosity | 40° C. Viscosity | VI | Pour Point, ° C. |
|---|---|---|---|---|---|
| 1 | 25/10/50/15 | 102.2 | 1325 | 166 | −30 |
| 2 | 20/10/55/15 | 128 | 1669 | 176 | −30 |

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples. Rather, many variations will suggest themselves to those skilled in this art in light of the above detailed description. All such obvious variations are within the full intended scope of the appended claims. Preferred embodiments of the present invention include: a process for producing a polyalphaolefin (PAO) comprising contacting a feed comprising 1-hexene, 1-dodecene, and 1-tetradecene or 1-hexene/1-octene/1-dodecene/1-tetradecene or 1-hexene/1-decene/1-dodecene/1-tetradecene with an oligomerization catalyst in an oligomerization reaction zone under oligomerization conditions for a time sufficient to produce a PAO having a viscosity of from about 20 cSt to about 100 cSt at 100° C. (ASTM D-445), and a number average molecular weight of between about 1000 to about 4000; more preferred embodiments of this process including at least one of the limitations selected from the following, which may be combined in a manner that would be apparent and practicable to one of ordinary skill in the art in possession of the present disclosure: wherein said feed comprises 5-90% 1-hexene monomer units (as previously stated, all feed amounts used herein are in wt % unless otherwise specified), 5-90% 1-dodecene and 5-90% % 1-tetradecene monomer units, on a weight basis; wherein said feed comprises on a weight basis 5-90% 1-hexene, 5-90% 1-octene, 5-90% 1-dodecene, 5-90% 1-tetradecene; wherein said feed comprises on a weight basis 5-90% 1-hexene, 5-90% 1-decene, 5-90% 1-dodecene, 5-90% 1-tetradecene; wherein said feed comprises 5-70% 1-hexene monomer units, 25-90% 1-dodecene and 5-70% % 1-tetradecene monomer units, on a weight basis; wherein said feed comprises on a weight basis 5-70% 1-hexene, 5-70% 1-octene, 25-85% 1-dodecene, 5-70% 1-tetradecene; wherein said feed comprises on a weight basis 5-70% 1-hexene, 5-70% 1-decene, 25-85% 1-dodecene, 5-70% 1-tetradecene; wherein said feed comprises 5-50% 1-hexene monomer units, 40-90% 1-dodecene and 5-50% % 1-tetradecene monomer units, on a weight basis; wherein said feed comprises on a weight basis 5-50% 1-hexene, 5-50% 1-octene, 40-85% 1-dodecene, 5-50% 1-tetradecene; wherein said feed comprises 5-50% 1-hexene, 5-50% 1-decene, 40-85% 1-dodecene, 5-50% 1-tetradecene units, on a weight basis; wherein said PAO has a kinematic viscosity of about 40 cSt at 100° C. (ASTM D-445), a viscosity index of at least about 145 (ASTM D-2270), and a pour point of less than or equal to about −39° C. (ASTM D-97); wherein said PAO has a kinematic viscosity of about 100 cSt at 100° C. (ASTM D-445), a viscosity index of at least about 170 (ASTM D-2270), and a pour point of less than or equal to about −30° C. (ASTM D-97); wherein said feed further comprises a diluent; wherein said diluent comprises at least one hydrocarbon fluid selected from C6-C13 paraffinic fluids;

wherein said oligomerization catalyst is selected from $AlCl_3$, $AlBr_3$, and mixtures thereof; wherein said oligomerization catalyst is an $AlCl_3$-water complex having 0.5 moles of water per mole of $AlCl_3$; wherein said oligomerization reaction zone comprises a continuous stirred tank reactor (CSTR); wherein said oligomerization reaction zone comprises more than one oligomerization reactor in series; wherein the oligomerization conditions in said reactor include a temperature of from about 26 and 60° C. and a pressure of from about atmospheric to about 50 psia; further comprising a step of distillation to remove unreacted monomeric and dimeric species, followed by hydrogenation of the resulting product, without further separation, to saturate the oligomers, followed by recovery of said PAO; and also a preferred embodiment including a composition made by any one or more of the preceding processes, as would be apparent and practicable to one of ordinary skill in the art in possession of the present disclosure, and/or also additional limitations that are more preferred which are selected from at least one of the following: wherein said at least one PAO comprising C30-C36 trimers, C40-C48 tetramers, and C50-C60 tetramers of 1-decene and 1-dodecene; and wherein said at least one PAO is selected from a PAO having a viscosity of about 40 cSt at 100° C., a PAO having a viscosity of about 100 cSt at 100° C.

Trade names used herein are indicated by a ™ symbol or ® symbol, indicating that the names may be protected by certain trademark rights, e.g., they may be registered trademarks in various jurisdictions. All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

What is claimed is:

1. A process for producing a polyalphaolefin (PAO) comprising contacting a feed consisting of 15-30 wt % 1-hexene, 45-70 wt % 1-dodecene, and 15-40 wt % 1-tetradecene, with an oligomerization catalyst in an oligomerization reaction zone under oligomerization conditions for a time sufficient to produce a PAO having a kinematic viscosity of from about 40 cSt to about 100 cSt at 100° C. (ASTM D-445), a viscosity index of at least 145 (ASTM-2270), a pour point of less than or equal to about −24° C. (ASTM D-97), and a number average molecular weight of from about 1000 to about 4000.

2. The process according to claim 1, wherein said PAO has a kinematic viscosity of about 40 cSt at 100° C. (ASTM D-445), a viscosity index of at least about 145 (ASTM D-2270), and a pour point of less than or equal to about −36° C. (ASTM D-97).

3. The process according to claim 1, wherein said PAO has a kinematic viscosity of about 100 cSt at 100° C. (ASTM D-445), a viscosity index of at least about 170 (ASTM D-2270), and a pour point of less than or equal to about -24° C. (ASTM D-97).

4. The process according to claim 1, wherein said feed further comprises a diluent.

5. The process according to claim 1, wherein said oligomerization catalyst is selected from $AlCl_3$, $AlBr_3$, and mixtures thereof.

6. The process according to claim 1, wherein said oligomerization catalyst is an $AlCl_3$-water complex having 0.5 moles of water per mole of $AlCl_3$.

7. The process according to claim 1, wherein said oligomerization reaction zone comprises a continuous stirred tank reactor (CSTR).

8. The process according to claim 1, wherein said oligomerization reaction zone comprises more than one oligomerization reactor in series.

9. The process according to claim 1, wherein said oligomerization conditions include a temperature of from about 25 and 70° C. and a pressure of from about atmospheric to about 50 psia.

10. The process according to claim 1, further comprising a step of distillation to remove unreacted monomeric and dimeric species, followed by hydrogenation of the resulting product, without further separation, to saturate the oligomers, followed by recovery of said PAO.

11. A process for producing a polyalphaolefin (PAO) comprising contacting a feed consisting of 20-25 wt % 1-hexene, 40-55 wt % 1-dodecene, 15-25 wt % 1-tetradecene, and 1-octene, with an oligomerization catalyst in an oligomerization reaction zone under oligomerization conditions for a time sufficient to produce a PAO having a kinematic viscosity of from about 40 cSt to about 100 cSt at 100° C. (ASTM D-445), a viscosity index of at least 145 (ASTM-2270), a pour point of less than or equal to about −24° C. (ASTM D-97),and a number average molecular weight of from about 1000 to about 4000.

12. A process for producing a polyalphaolefin (PAO) comprising contacting a feed consisting of 20-25 wt % 1-hexene, 45-55 wt % 1-dodecene, 15-20 wt % 1-tetradecene, and 1-decene, with an oligomerization catalyst in an oligomerization reaction zone under oligomerization conditions for a time sufficient to produce a PAO having a kinematic viscosity of from about 40 cSt to about 100 cSt at 100° C. (ASTM D-445), a viscosity index of at least 145 (ASTM-2270), a pour point of less than or equal to about −24° C. (ASTM D-97), and a number average molecular weight of from about 1000 to about 4000.

* * * * *